US009989342B1

(12) United States Patent
Lougeay et al.

(10) Patent No.: US 9,989,342 B1
(45) Date of Patent: Jun. 5, 2018

(54) CASE ORIENTATION DEVICE

(71) Applicants: James N. Lougeay, Belleville, IL (US); William J. Birmingham, Farmington, MO (US)

(72) Inventors: James N. Lougeay, Belleville, IL (US); William J. Birmingham, Farmington, MO (US)

( * ) Notice: Subject to any disclaimer, the term of this patent is extended or adjusted under 35 U.S.C. 154(b) by 0 days. days.

(21) Appl. No.: 15/833,017

(22) Filed: Dec. 6, 2017

Related U.S. Application Data

(60) Provisional application No. 62/431,377, filed on Dec. 7, 2016.

(51) Int. Cl.
*F42B 33/00* (2006.01)

(52) U.S. Cl.
CPC ..... *F42B 33/002* (2013.01)

(58) Field of Classification Search
CPC ..... F42B 33/002; F42B 33/001; F42B 33/00
USPC ..... 86/45, 46
See application file for complete search history.

(56) References Cited

U.S. PATENT DOCUMENTS 143,981 A * 10/1873 Hobbs ..... F42B 33/001 72/424
232,169 A * 9/1880 Bennet ..... F42B 33/002 193/45
406,466 A * 7/1889 Place ..... F42B 33/002 86/46
620,350 A * 2/1899 McGrail ..... F42B 33/14 221/171
1,232,893 A * 7/1917 Candee ..... B65G 47/1428 193/45
1,340,432 A * 5/1920 Benjamin ..... F42B 33/002 193/45
2,371,126 A * 3/1945 Best ..... B65G 47/1457 221/182
2,381,893 A * 8/1945 Fernald ..... B65G 47/1478 193/48
2,387,672 A * 10/1945 Mayherry ..... F42B 33/002 29/821
2,419,242 A * 4/1947 Woodberry ..... F42B 39/10 193/47
2,433,010 A * 12/1947 Woodberry ..... F42B 39/10 193/47
2,453,736 A * 11/1948 Woodberry ..... F42B 39/10 193/45

(Continued)

*Primary Examiner* — Derrick R Morgan
(74) *Attorney, Agent, or Firm* — PatentFile, LLC; Bradley C. Fach; Steven R. Kick

(57) ABSTRACT

A case orientation device may include an input chute coupled to a discharge chute via a funnel. The input chute may have a width dimension which may be greater than the length dimension of the ammunition case. The discharge chute may have a width dimension which may be less than the less than the length dimension of the case. The funnel may transition from the width dimension of the input chute to the width dimension of the discharge chute. A splitter may be disposed in the funnel, and the splitter may have a tipping surface which may be oriented towards the input chute. A case may enter the input chute in a horizontal orientation, may be rotated out of the horizontal orientation via contact with the tipping surface, and may be forced into a vertical orientation to enter the discharge chute in the vertical orientation.

14 Claims, 17 Drawing Sheets

(56) References Cited

U.S. PATENT DOCUMENTS 2,623,803 A * 12/1952 Gamble ..... F42B 39/002 144/245.1
2,635,261 A * 4/1953 Stewart ..... B65G 47/1478 221/175
2,818,964 A * 1/1958 Picard ..... F42B 33/002 112/108
2,857,039 A * 10/1958 Whitecar ..... B65G 47/248 134/62
3,240,103 A * 3/1966 Lamont ..... F42B 33/002 221/277
3,295,659 A * 1/1967 Aidlin ..... B65G 47/1457 193/44
3,659,492 A * 5/1972 Fullmer ..... B65G 47/1457 221/10
3,831,734 A * 8/1974 Hoppnnann ..... B65D 1/095 198/382
3,912,120 A * 10/1975 Hoppnnann ..... B07C 5/02 198/392
4,261,680 A * 4/1981 Carnley ..... B65G 47/24 198/376
4,455,915 A * 6/1984 Ransom ..... F42B 33/002 86/26
4,821,920 A * 4/1989 Lin ..... B65G 47/1457 198/397.05
4,828,100 A * 5/1989 Hoppnnann ..... B65G 47/1428 198/392
6,073,533 A * 6/2000 Brandon ..... F42B 39/002 222/181.3
7,552,668 B1 * 6/2009 Gonzalez ..... F42B 33/00 86/45
8,051,971 B2 * 11/2011 Marti Sala ..... B65G 47/1457 198/392
8,096,403 B2 * 1/2012 Marti Sala ..... B65G 47/1457 198/384
8,978,869 B2 * 3/2015 Schombert ..... B65G 47/1457 198/392
9,689,651 B1 * 6/2017 Lee ..... F42B 33/002
9,719,741 B1 * 8/2017 Cifers ..... F41A 9/83
2013/0125737 A1 * 5/2013 Koskela ..... B65G 47/1457 86/45
2013/0152771 A1 * 6/2013 Coma Asensio .. B65G 47/1457 86/19.5
2014/0373421 A1 * 12/2014 Hatch ..... F41A 9/83 42/87
2016/0305726 A1 * 10/2016 Mokuolu ..... F41A 9/83

* cited by examiner

CASE ORIENTATION DEVICE

CROSS REFERENCE TO RELATED APPLICATIONS

This application claims priority to and the benefit of the filing date of U.S. Provisional Application No. 62/431,377, filed on Dec. 7, 2016, entitled "CASE PLATE AND CASE ORIENTATION DEVICE AND CASE ORIENTATION DEVICE MOUNT FOR CARTRIDGE CASE COLLATOR, AND METHODS THERETO", which is hereby incorporated by reference in its entirety.

FIELD OF THE INVENTION

This patent specification relates to the field of devices for sorting ammunition cases or casings. More specifically, this patent specification relates to a device for sorting ammunition cases into a single orientation.

BACKGROUND

Cartridge-type firearm ammunition typically includes a primer, projectile, and propellant which are held together by a case. Loaded or live ammunition is generally referred to as "cartridges," while "cases", "casings", or "shells" generally refer to the empty case or spent ammunition cartridges. All machines which process ammunition cases require that the cases be presented to the machine in a particular orientation. Orientation of the cases may be accomplished by hand sorting or via a case collator. Performing this orientation function on bottle-neck cases is particularly difficult due to the ratio of length to diameter of the case. Additionally, the majority of the mass of the case tends to be distributed at one end of the case.

Typical collators consist of a cylindrical bowl tilted at an angle from horizontal, a motor-driven case plate with pockets that receive and orient the cases, and an opening in the base beneath the case plate through which the cases fall in proper orientation. The simple design of the typical case plate limits throughput and causes frequent jams resulting in a lengthy case orientation process.

Therefore a need exists for novel devices for sorting ammunition cases. A further need exists for novel devices for sorting ammunition cases into a single orientation. There is also a need for novel devices for sorting bottle-neck ammunition cases. Finally, a need exists for novel devices for sorting bottle-neck ammunition cases that provides a high throughput without frequent jams resulting in a short or quick case orientation process.

BRIEF SUMMARY OF THE INVENTION

A case orientation device is provided which may be configured to sort ammunition cases having a length dimension and a diameter dimension into a single orientation. In some embodiments, the device may include an input chute coupled to a discharge chute via a funnel. The input chute may have a width dimension which may be greater than the length dimension of the ammunition case. The discharge chute may have a width dimension which may be less than the less than the length dimension of the case, and preferably slightly larger than the diameter dimension of the case. The funnel may transition from the width dimension of the input chute to the width dimension of the discharge chute. A splitter may be disposed in the funnel, and the splitter may divide the funnel into a right section and a left section. The splitter may have a tipping surface, and the tipping surface may be oriented towards the input chute. A case may enter the input chute in a horizontal orientation, may be rotated out of the horizontal orientation via contact with the tipping surface, and may be forced into a vertical orientation in one of the sections to enter the discharge chute in the vertical orientation.

In further embodiments, the device may further comprise a case plate having a plurality of drop pockets, and the case plate may be rotatable around an axis of rotation. The drop pockets may be configured to receive a case. Each drop pocket may be sequentially aligned with the input chute of the case orientation device as the case plate is rotated to allow a case received in the aligned drop pocket to be communicated into the input chute in which the case may be in a horizontal orientation.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
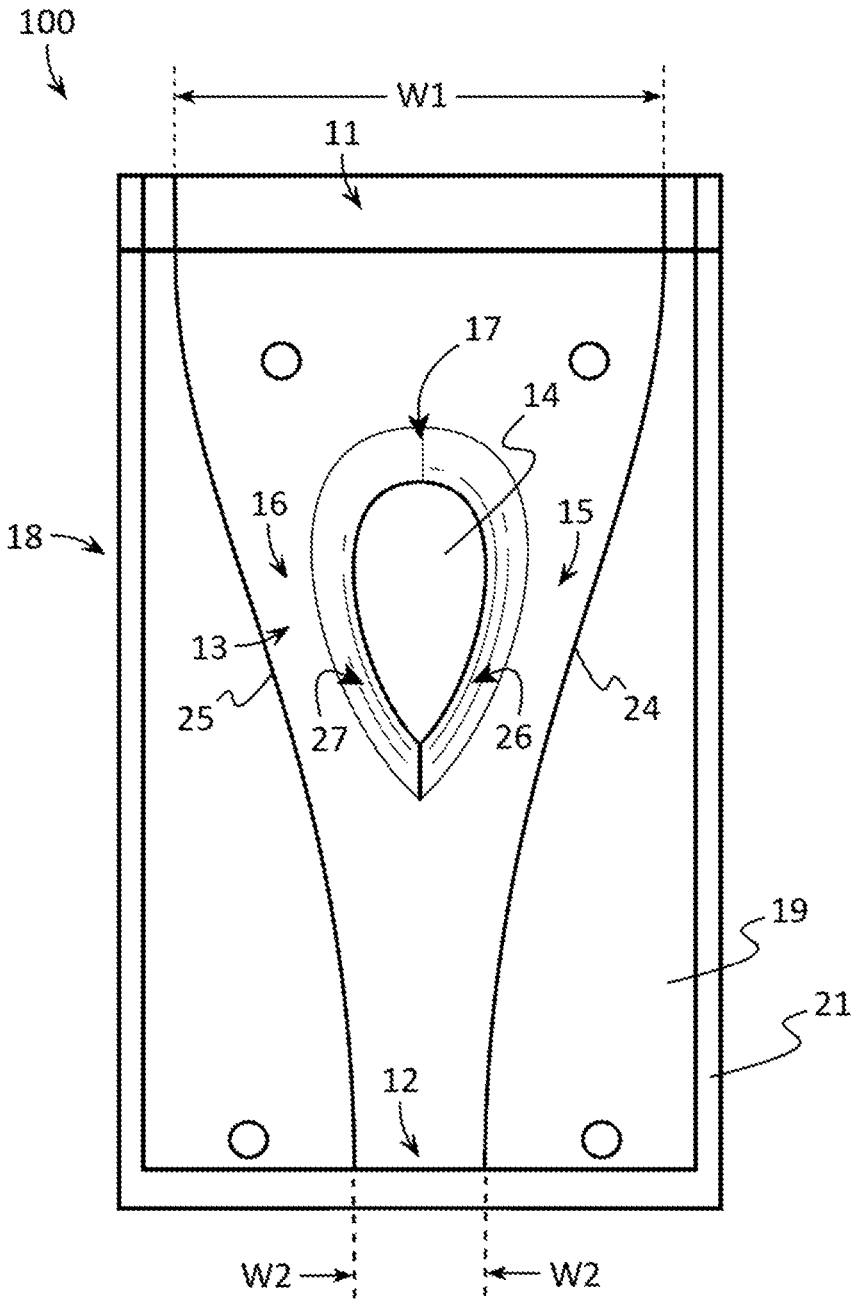
FIG. 1 depicts a front elevation view of an example of a case orientation device according to various embodiments described herein.
Figure 2:
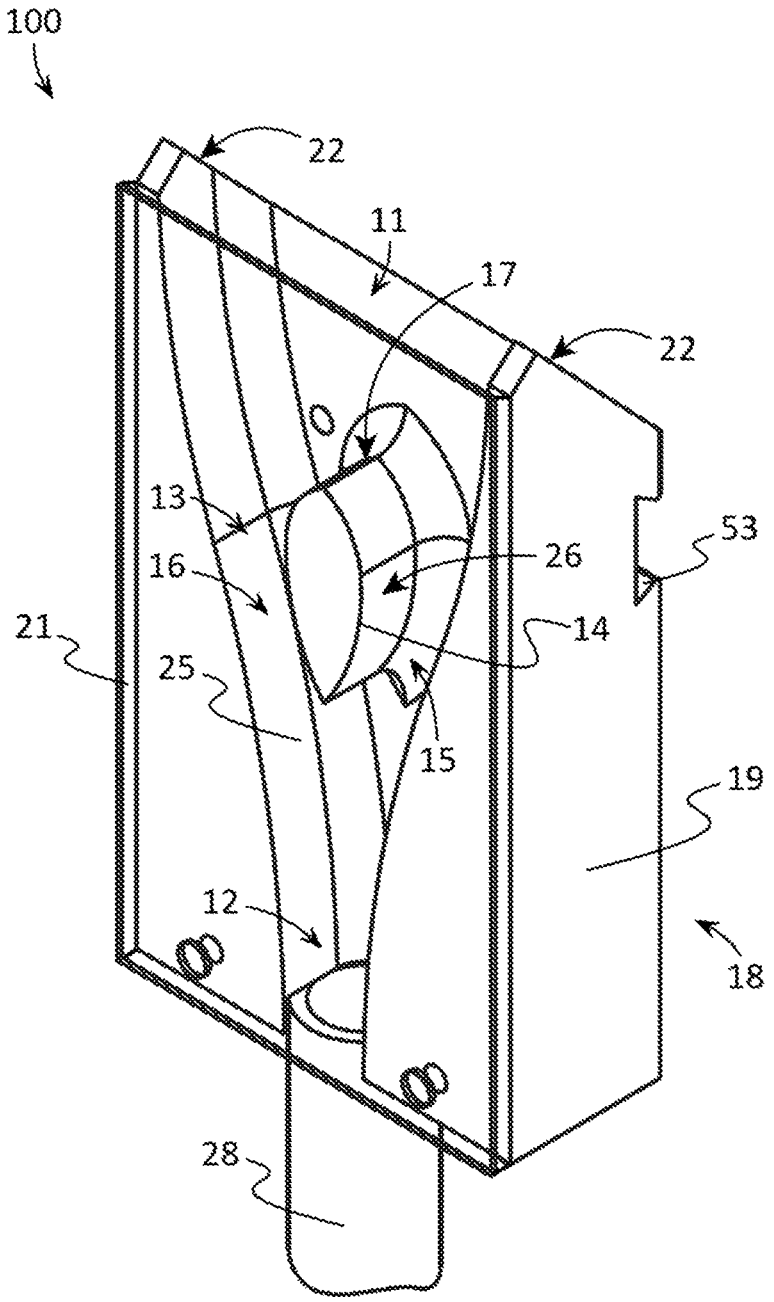
FIG. 2 illustrates a perspective view of an example of a case orientation device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application and unless otherwise noted, the term "about" or "approximately" refers to a range of values within plus or minus 10% of the specified number. Additionally, as used in this application and unless otherwise noted, the term "substantially" means that the actual value is within about 10% of the actual desired value, particularly within about 5% of the actual desired value and especially within about 1% of the actual desired value of any variable, element or limit set forth herein.

A new device for sorting ammunition cases into a single orientation is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 15:
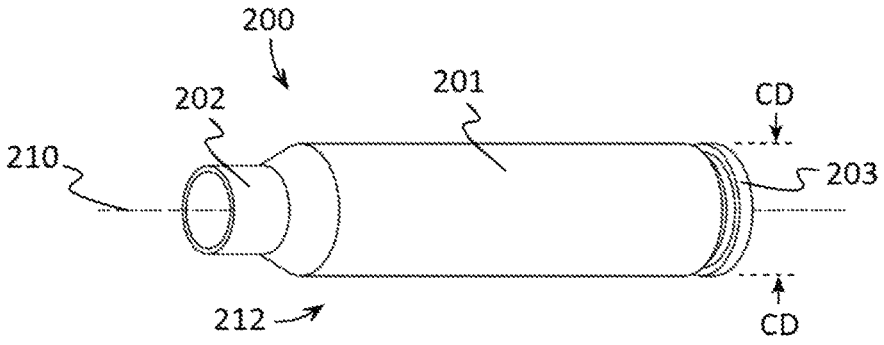
FIG. 15 shows a perspective view of an example of an ammunition case in a horizontal orientation according to various embodiments described herein.
Figure 16:
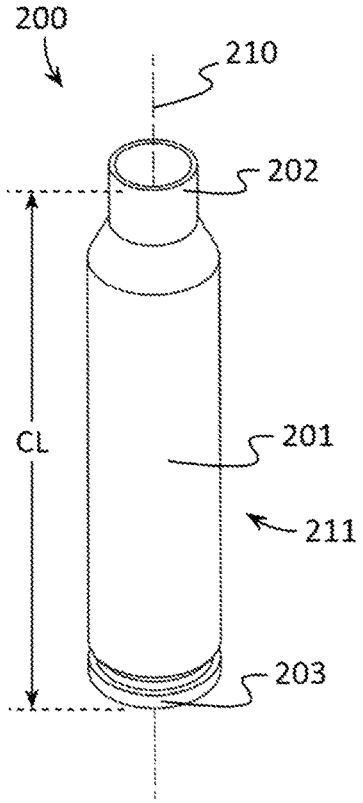
FIG. 16 depicts a perspective view of an example of an ammunition case in a vertical orientation according to various embodiments described herein.

The present invention will now be described by example and through referencing the appended figures representing preferred and alternative embodiments. FIGS. 1 - 6 illustrate examples of a case orientation device ("the device") 100 according to various embodiments. The device 100 may be used with one or more ammunition cases ("cases") 200, and the device 100 may be configured to sort one or more cases 200 into a single orientation, such as the vertical orientation 211 depicted in FIG. 16. Each case 200 may comprise a length dimension (CL) which may describe the overall length of the case 200 and a diameter dimension (CD) which may describe the largest diameter of the case 200 as shown in FIG. 15. Cases 200 may comprise a case axis 210 which may extend from the center of the neck 202 to the center of the rim 203. A midpoint 201 may be defined generally as the middle of the case 200 or approximately half of its length dimension (CL).

In some embodiments, the device 100 may comprise an input chute 11 coupled to a discharge chute 12 via a funnel 13. The input chute 11 may have a width dimension (W1) which may be greater than the CL of a case 200. The discharge chute 12 may have a width dimension (W2) which may be less than the CL of a case 200. The funnel 13 may transition from the W1 of the input chute 11 to the W2 of the discharge chute 12. A splitter 14 may be disposed in the funnel 13, and the splitter 14 may divide the funnel 13 into a right section 15 and a left section 16. The splitter 14 may have a tipping surface 17, and the tipping surface 17 may be oriented towards the input chute 11. A case 200 may enter the input chute 11 in a horizontal orientation 212, may be rotated out of the horizontal orientation 212 via contact with the tipping surface 17, and may be forced into a vertical orientation 211 in one of the sections 15, 16, to enter the discharge chute 12 in the vertical orientation 211.

In some embodiments, the input chute 11, discharge chute 12, funnel 13, and splitter 14 may be formed or contained in an orientation assembly 18 which may be formed from or may comprise substantially rigid materials such as steel alloys, aluminum, aluminum alloys, copper alloys, any other type of metal or metal alloy, ceramics, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiber glass, carbon fiber, resins, such as epoxy resin, wood, other plant based materials, or any other material including combinations of materials.

In some embodiments, the orientation assembly 18 may comprise an orientation housing 19 which may be coupled to a cover 21, and the input chute 11, discharge chute 12, funnel 13, and splitter 14 may be formed into portions of the orientation housing 19 and/or cover 21. Preferably, the cover 21 may be removably coupled to the orientation housing 19 and/or made from a substantially clear or transparent substantially rigid material such as polycarbonate or other plastic. The orientation assembly 18 may comprise one or more assembly mounting surfaces 22 which may be placed in contact with, coupled to, or placed in close proximity with a backing plate 43.

Figure 17:
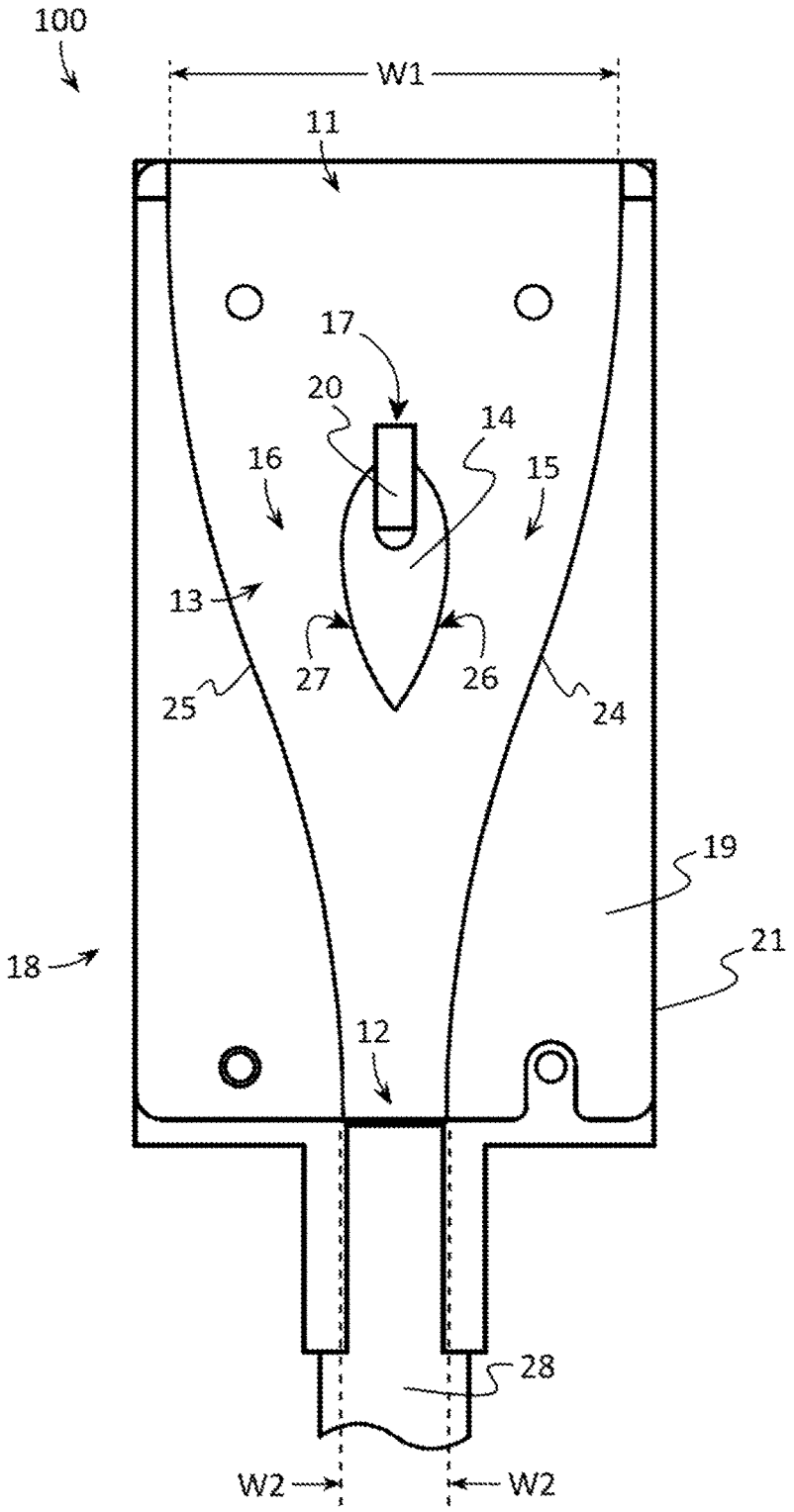
FIG. 17 depicts a front elevation view of a further example of a case orientation device according to various embodiments described herein.

The input chute 11 and discharge chute 12 may be coupled together via the funnel 13, and the funnel 13 may transition in width from the width of the input chute (W1) to the width of the discharge chute (W2). In some embodiments and as shown in FIGS. 1 and 17, W1 may be greater than the length dimension (CL) of the cases 200 which are to be received by the input chute 11 so that a case 200 may enter the input chute 11 in a generally horizontal orientation 212. In preferred embodiments, the W1 of the input chute 11 may be approximately 101 to 200%, and more preferably approximately 120 to 165%, of the CL of the cases 200. In further embodiments, W2 may be greater than the diameter dimension (CD) of the cases 200 which are to be received by the input chute 11 so that a case 200 may exit the discharge chute 12 in a generally vertical orientation 211. In further preferred embodiments, the W2 of the discharge chute 12 may be approximately 101 to 150%, and more preferably approximately 120 to 145%, of the CD of the cases 200.

Figure 18:
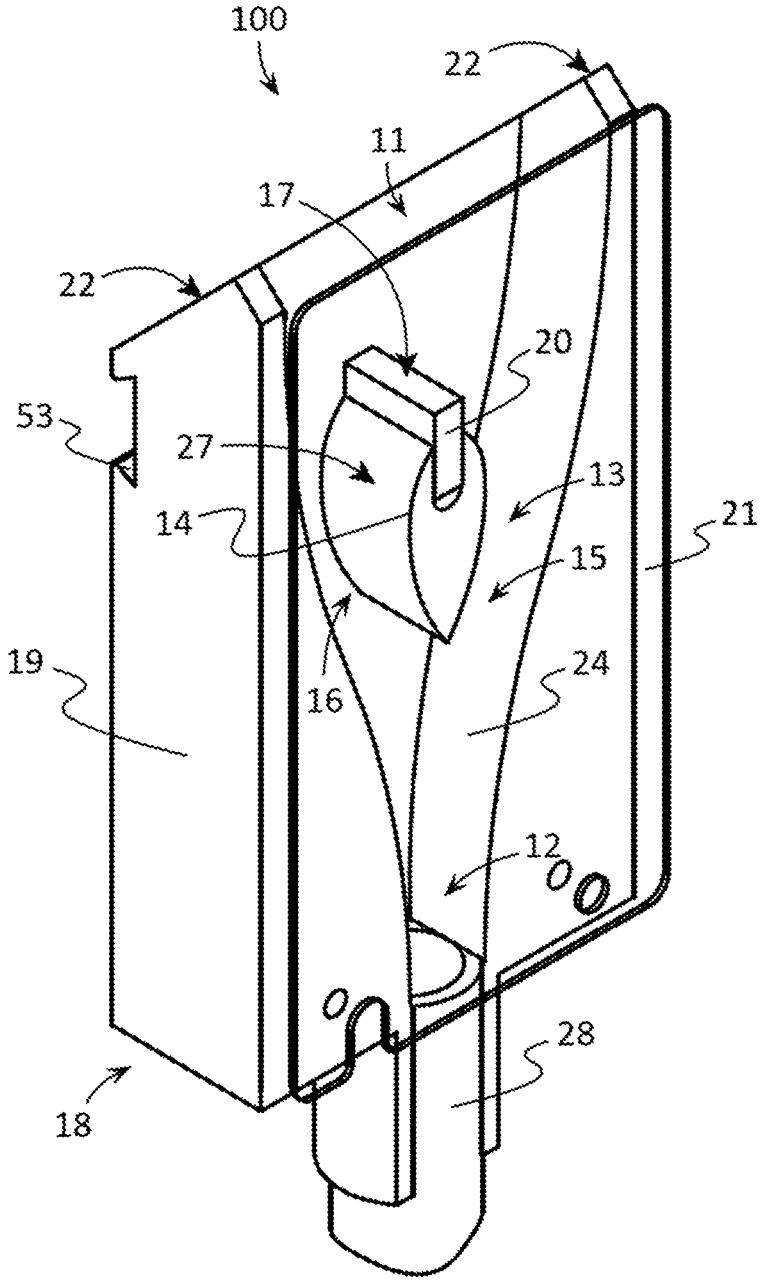
FIG. 18 illustrates a perspective view of a further example of a case orientation device according to various embodiments described herein.

Referring to FIGS. 1, 2, 17, and 18, the funnel 13 may comprise a right wall 24 and an opposing left wall 25 which may couple or join the input chute 11 and the discharge chute 12. A splitter 14 may be positioned or disposed within the funnel 13, and the splitter 14 may divide the funnel 13 into a right section 15 and a left section 16. The splitter 14 may comprise a tipping surface 17 which may be oriented towards the input chute 11. In some embodiments, the splitter 14 may comprise a generally tear drop shape or a generally symmetrical airfoil shape; while in other embodiments, the splitter 14 may comprise a generally cylindrical shape, triangular prism shape, rectangular prism shape, or any other shape. Preferably, a splitter 14 may comprise a right longitudinal surface 26 and a left longitudinal surface 27. The right section 15 may be formed between the right longitudinal surface 26 and the right wall 24, and the left section 16 may be formed between the left longitudinal surface 27 and the left wall 25. In some embodiments and as shown in the examples of FIGS. 17 and 18, a tipping surface 17 may be formed on a splitter extension 20 that may extend away and above from the longitudinal surface 26, 27, towards the input chute 11. In further embodiments, a tipping surface 17, splitter extension 20, and/or any other part of the splitter 14 may be formed from or comprise a resilient material, such as such as a natural and/or synthetic rubber material such as latex rubber, forms of the organic compound isoprene, Polyacrylate Rubber, Ethylene-acrylate Rubber, Polyester Urethane, a flexible plastic such as high-density polyethylene (HDPE), polyvinyl chloride (PVC), polypropylene (PP), Polystyrene (PS), Polycarbonate (PC), low density polyethylene (LDPE), or any other resilient material including combinations of materials.

The splitter 14 and the tipping surface 17 may be positioned centrally in the funnel 13 so that a case 200 passing through the input chute 11 in a horizontal orientation 212 will be contacted at approximately the midpoint 201 of the case 200 with the midpoint 201 being approximately located half way between the neck 202 and rim 203 of the case 200. Since the rim 203 is heavier than the neck 202, contact of the midpoint 201 with the tipping surface 17 will cause the rim 203 to rotate into the right section 15 or the left section 16, before the neck 202 so that the case 200 is rotated into a neck-up vertical orientation 211.

In some embodiments, the device 100 may comprise a delivery tube 28 which may be in communication with the input chute 11, preferably by being coupled to the orientation housing 19 or other element of the device 100. A delivery tube 28 may preferably comprise an elongated cylinder or tube through which cases 200 exiting the discharge chute 12 in the neck-up vertical orientation 211 may be directed through optionally via the action of gravity.

In some embodiments and as shown in FIGS. 3-6, the device 100 may comprise a feeding assembly 29 which may be configured to provide cases 200 to the input chute 11 in which the cases 200 are provided in the horizontal orientation 212. In preferred embodiments, a feeding assembly 29 may comprise a hopper 31 and a case plate 32. The hopper 31 may be shaped or configured to contain a plurality of cases 200 and to position the cases 200 so that they may contact the case plate 32. Optionally, the hopper 31 and case plate 32 may be coupled together. The case plate 32 may be rotatable around an axis of rotation 91, and the case plate 32 may comprise one, two, three, four, five, six, seven, eight, nine, ten, or more, such as a plurality of drop pockets 33. Each drop pocket 33 may pass through the case plate 32 and may be dimensioned slightly larger than the dimensions of a case 200 so that each drop pocket 33 may receive a case 200. The orientation assembly 18 may be coupled to the feeding assembly 29 so that as the case plate 33 is rotated, each drop pocket 33 may be sequentially aligned with the input chute 11. When a drop pocket 33 is aligned with the input chute 11, communication may be established between the drop pocket 33 and the input chute 11, thereby allowing a case 200 in the drop pocket 33 to move into the input chute 11, preferably under the action of gravity.

In some embodiments, the axis of rotation 91 of the case plate 32 may be offset from vertical 92 with vertical 92 being the direction opposite of gravity. In preferred embodiments, the axis of rotation 91 may be approximately between 1 and 89 degrees, and more preferably approximately between 25 and 65 degrees, relative to vertical 92 as shown by Angle A in FIG. 4. In still further preferred embodiments, the axis of rotation 91 may be approximately between 25 and 65 degrees relative to vertical 92, and the orientation assembly 18 having the input chute 11, funnel 13, and discharge chute 12 may be oriented approximately with vertical 92.

Figure 7:
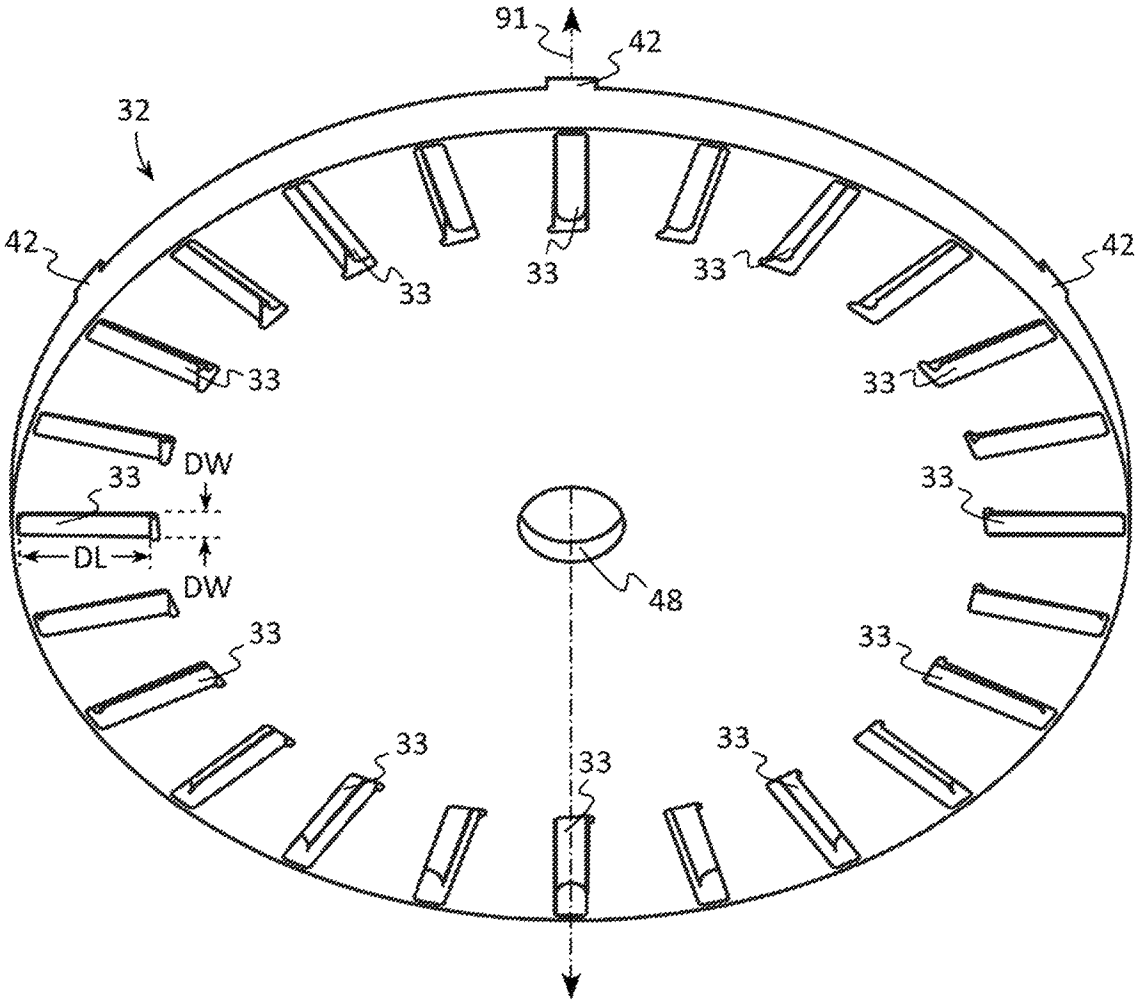
FIG. 7 depicts a rear perspective view of an example of a case plate according to various embodiments described herein.

In some embodiments, each drop pocket 33 may be generally rectangular in shape and may comprise a width dimension (DW) and a length dimension (DL) as shown in FIG. 7. In some embodiments, the DW of each drop pocket 33 may be approximately 101 to 150%, and more preferably approximately 105 to 120%, of the CD of the cases 200. In further embodiments, the DL of each drop pocket 33 may be approximately 101 to 150%, and more preferably approximately 105 to 115%, of the CL of the cases 200.

In some embodiments, one or more, and preferably each, drop pocket 33 may be coupled to a channel 34. The channels 34 may be shaped to receive portions of a case 200, such as by being semicylinder or cylindrical segment in shape. Generally, when a case 200 is received in a channel 34, the case 200 may slide in the channel 34 towards and away from the drop pocket 33 depending if the axis of rotation 91 causes the drop pocket 33 to be below or above the channel 34, respectively. In further embodiments, a channel 34 may comprise a length greater than CL of the case 200 so that preferably more than one case 200 may be received in the channel 34 at a time. Preferably, the case plate 32 may comprise one or more case abutments 40 which may be positioned at the end of a channel 34 that is distal to its respective drop pocket 33. The one or more case abutments 40 may limit the distance a case 200 is able to travel towards the center of the case plate 32 as the case plate 32 is rotated. In some embodiments, a case abutment 40 may comprise a ring or substantially annular shape which may extend around central portions of a case plate 32, such as around a case plate aperture 48. In other embodiments, a case abutment 40 may comprise a projection which may be disposed at the end of each channel 34 that is distal to its respective drop pocket 33.

In some embodiments, one or more, and preferably each, drop pocket 33 may be covered by a roof 35. Generally, a roof 35 may comprise a covering which may extend over the drop pocket 33 so that a case 200 received in the drop pocket 33 may be maintained in the drop pocket 33 until communication between the drop pocket 33 and input chute 11 is established. By covering the drop pocket 33 and a case 200 received therein, the roof 35 may prevent the case 200 from being dislodged from the drop pocket 33 from contact with other cases 200 in the hopper 31 as the case plate 32 is rotated. In further preferred embodiments, a drop pocket 33 may be covered by a roof 35, and a portion of the channel 34 that the drop pocket 33 is coupled to may also be covered by the roof 35.

In further embodiments, the case plate 32 may comprise one or more plate surfaces 36 into which the channels 34 may be formed or recessed below. Preferably, each roof 35 may be coupled to one or more plate surfaces 36 so that each roof 35 may extend above the plate surfaces 36. In some embodiments, a roof 35 may comprise a roof surface 37 and optionally an angled surface 38. A roof surface 37 may be generally parallel to the plate surfaces 36, and an angled surface 38 may be angled relative to the roof surface 37 and plate surfaces 36. In some embodiments, an angled surface 38 may be approximately parallel with the drop pocket 32 that its respective roof 35 is covering. In other embodiments, an angled surface 38 may be approximately parallel with an adjacent drop pocket 32 that its respective roof 35 is covering.

In further embodiments, the case plate 32 may comprise one or more arms 39. An arm 39 may be coupled to one side of a channel 34 and to the roof 35 of that channel 34 so that the arm 39 extends along the channel 34 towards the center of the case plate 32. An arm 39 may comprise an arm surface 41. In some embodiments, an arm surface 41 may be approximately level with the roof surface 37 of the roof 35 that the arm 39 is coupled to. In other embodiments, an arm surface 41 may be positioned below the roof surface 37 of the roof 35 that the arm 39 is coupled to. Optionally, one or more agitators 42 may be coupled to the case plate 32, such as by being coupled to a roof 35 or other surface on the case plate 32. In some embodiments, an agitator 42 may comprise a generally rectangular prism shape, while in other embodiments; an agitator 42 may be configured with any other shape.

In some embodiments, each drop pocket 33 may be disposed on the case plate 32 so that the drop pockets 33 are radially positioned or oriented relative to the axis of rotation 91 so that the DL of each drop pocket 33 may be approximately radially oriented to the axis of rotation 91. In further embodiments, each channel 34 and its respective drop pocket 33 may be disposed on the case plate 32 so that each channel 34 and its respective drop pocket 33 are radially positioned or oriented relative to the axis of rotation 91. In still further embodiments, each drop pocket 33, channel 34, and arm 39 may be disposed on the case plate 32 so that each drop pocket 33, channel 34, and arm 39 are radially positioned or oriented relative to the axis of rotation 91.

Figure 3:
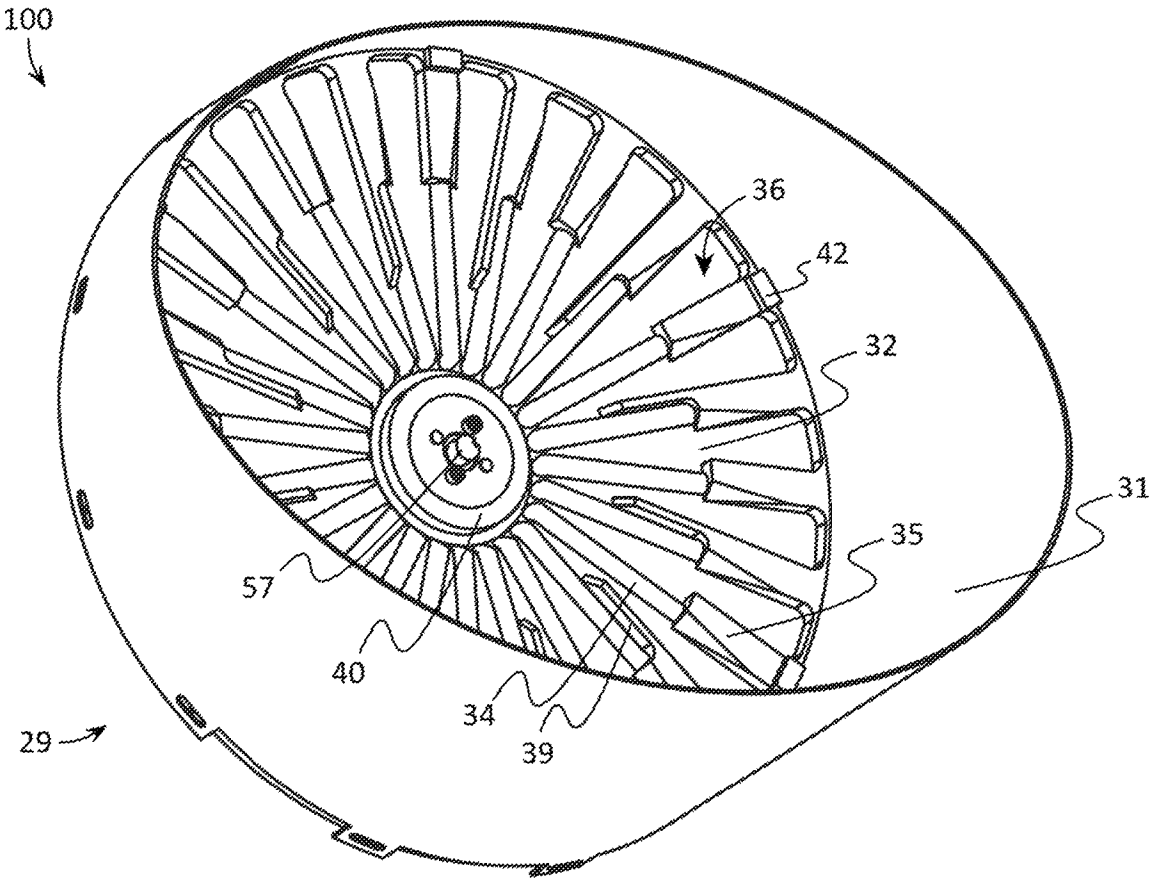
FIG. 3 shows a front perspective view of another example of a case orientation device according to various embodiments described herein.
Figure 4:
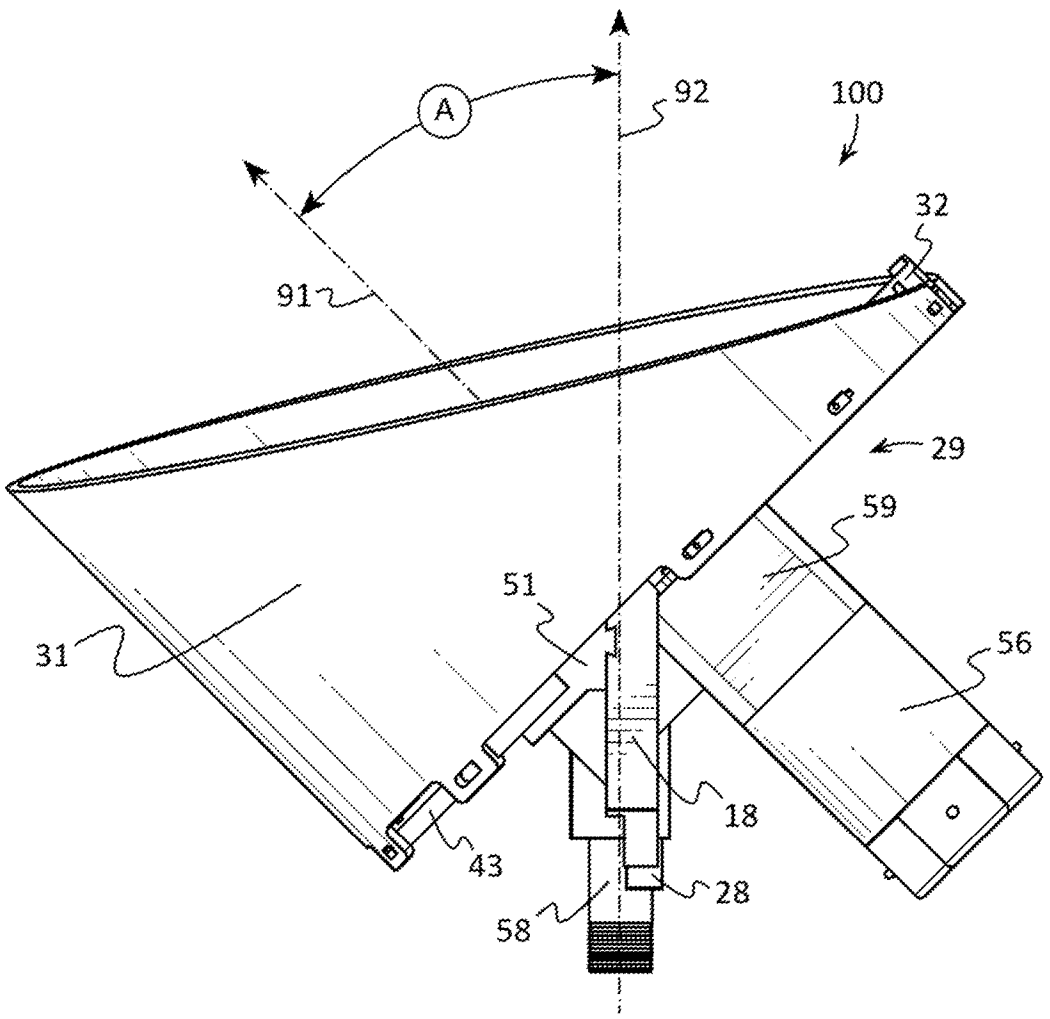
FIG. 4 depicts a side elevation view of another example of a case orientation device according to various embodiments described herein.
Figure 5:
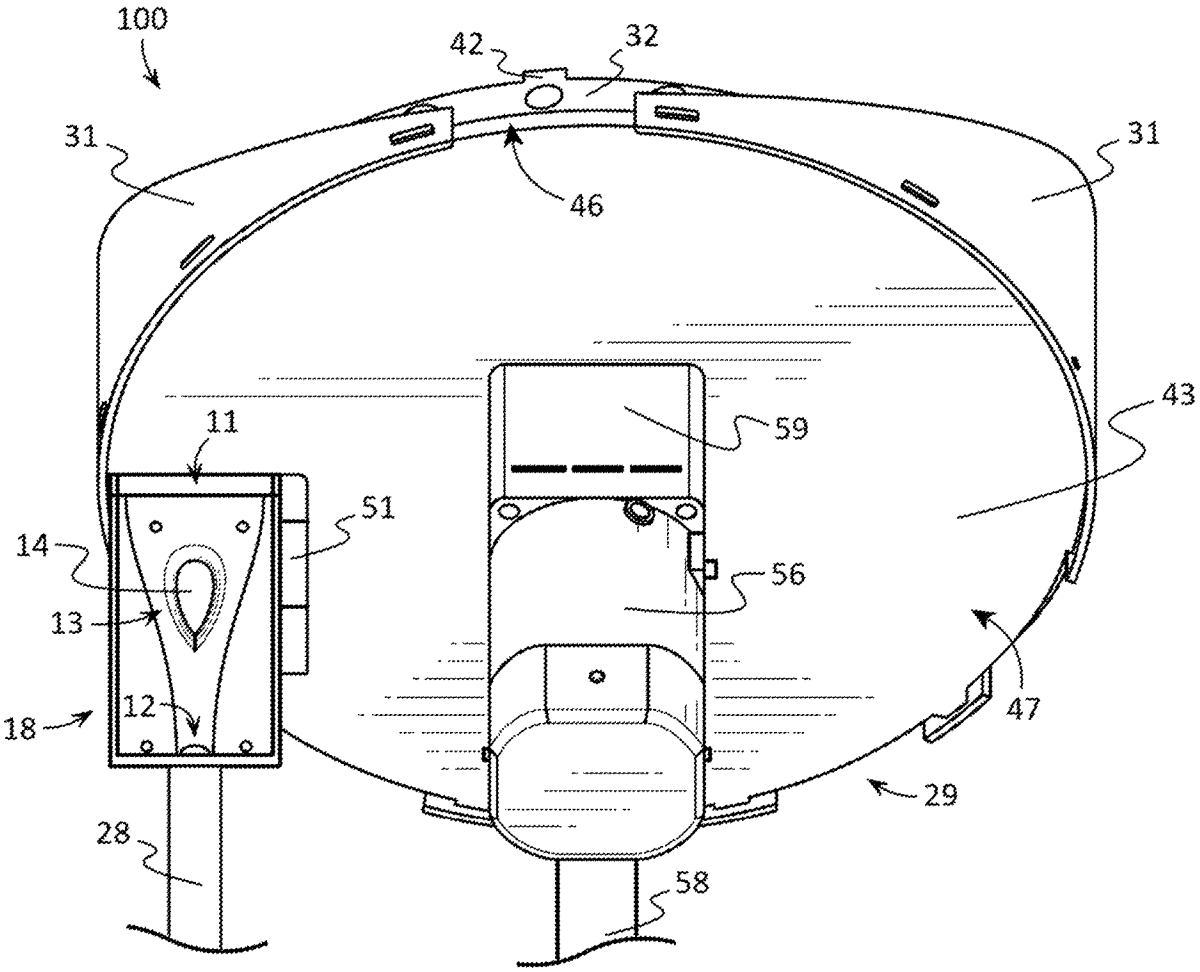
FIG. 5 illustrates a rear elevation view of another example of a case orientation device according to various embodiments described herein.
Figure 6:
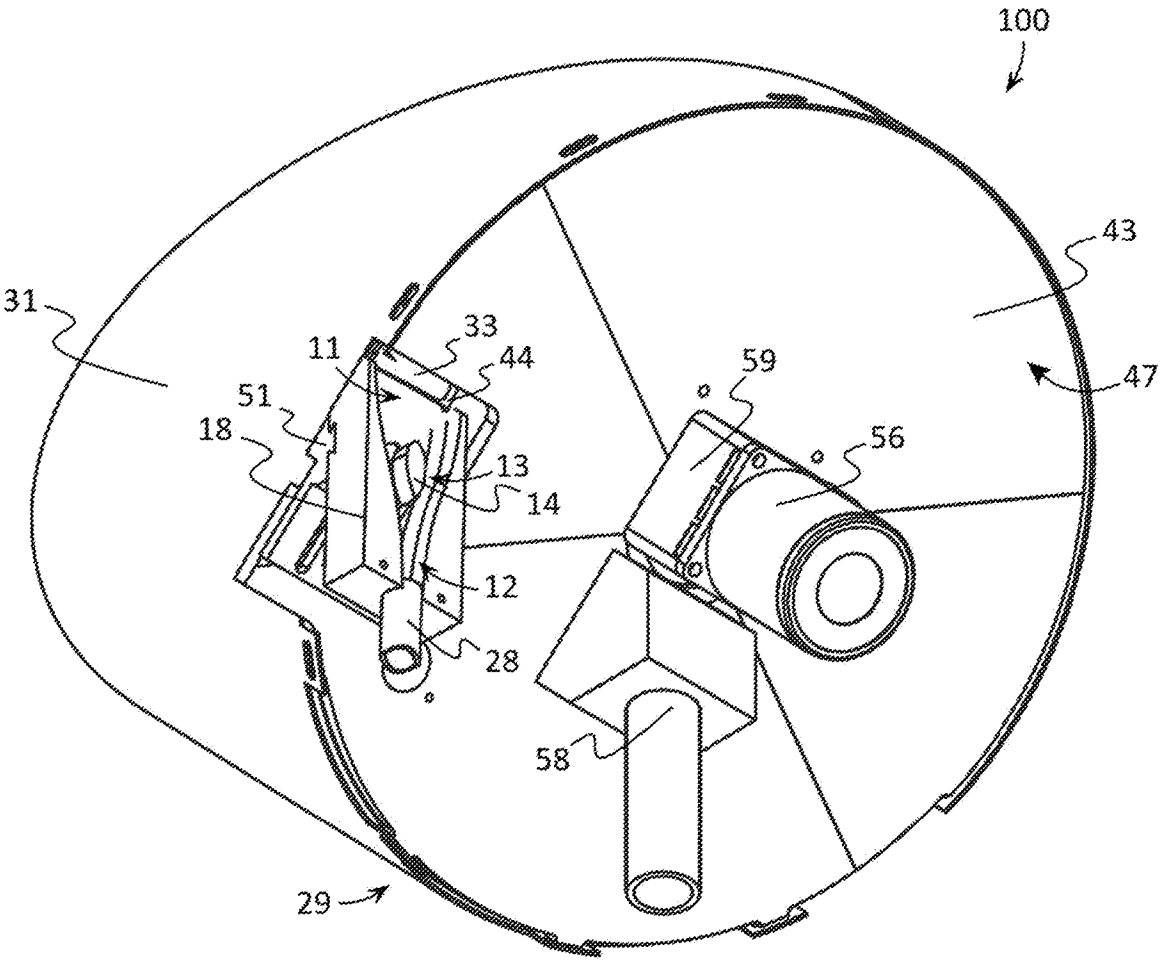
FIG. 6 shows a side rear perspective view of another example of a case orientation device according to various embodiments described herein.
Figure 8:
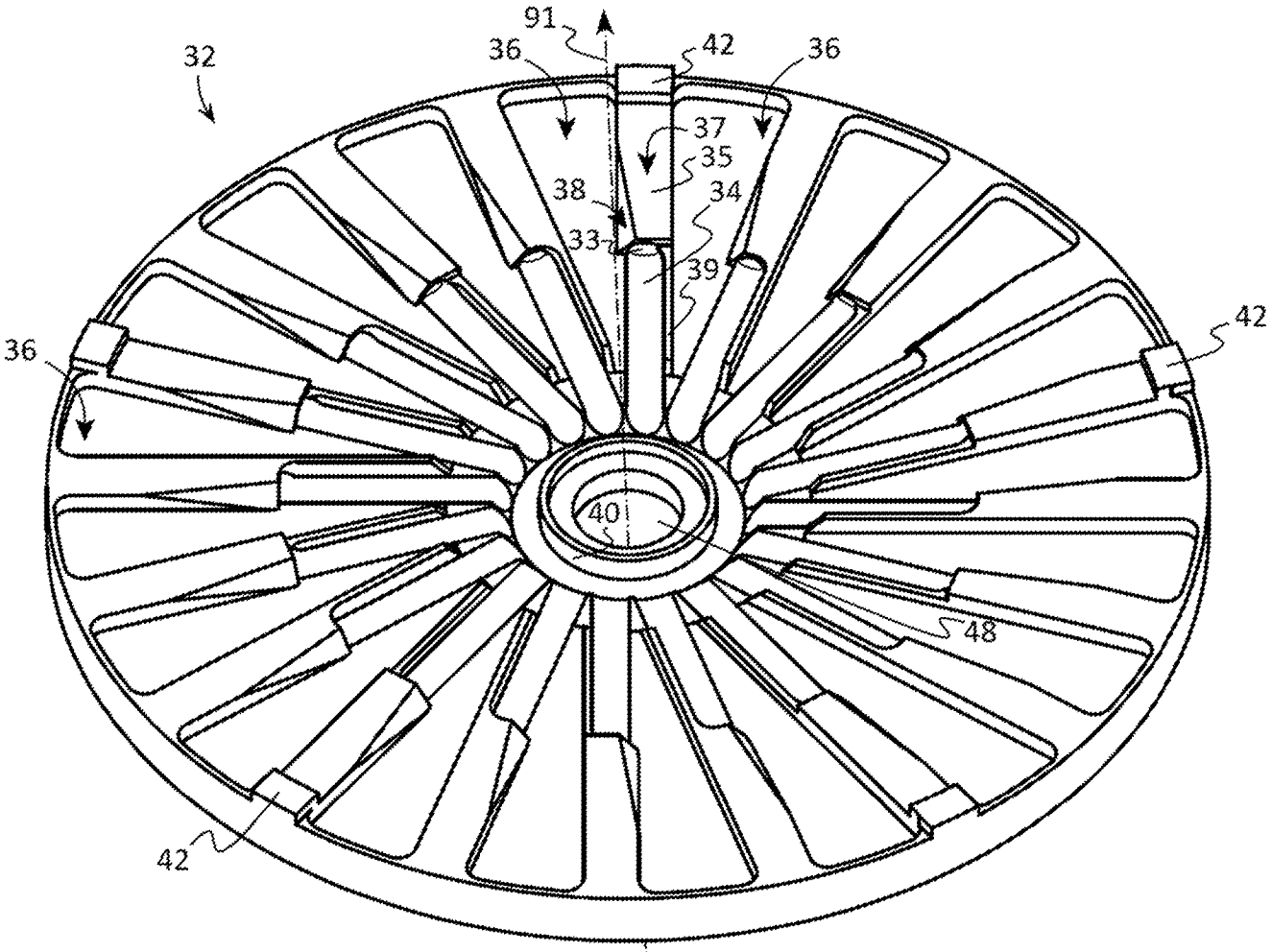
FIG. 8 illustrates a front perspective view of an example of a case plate according to various embodiments described herein.
Figure 9:
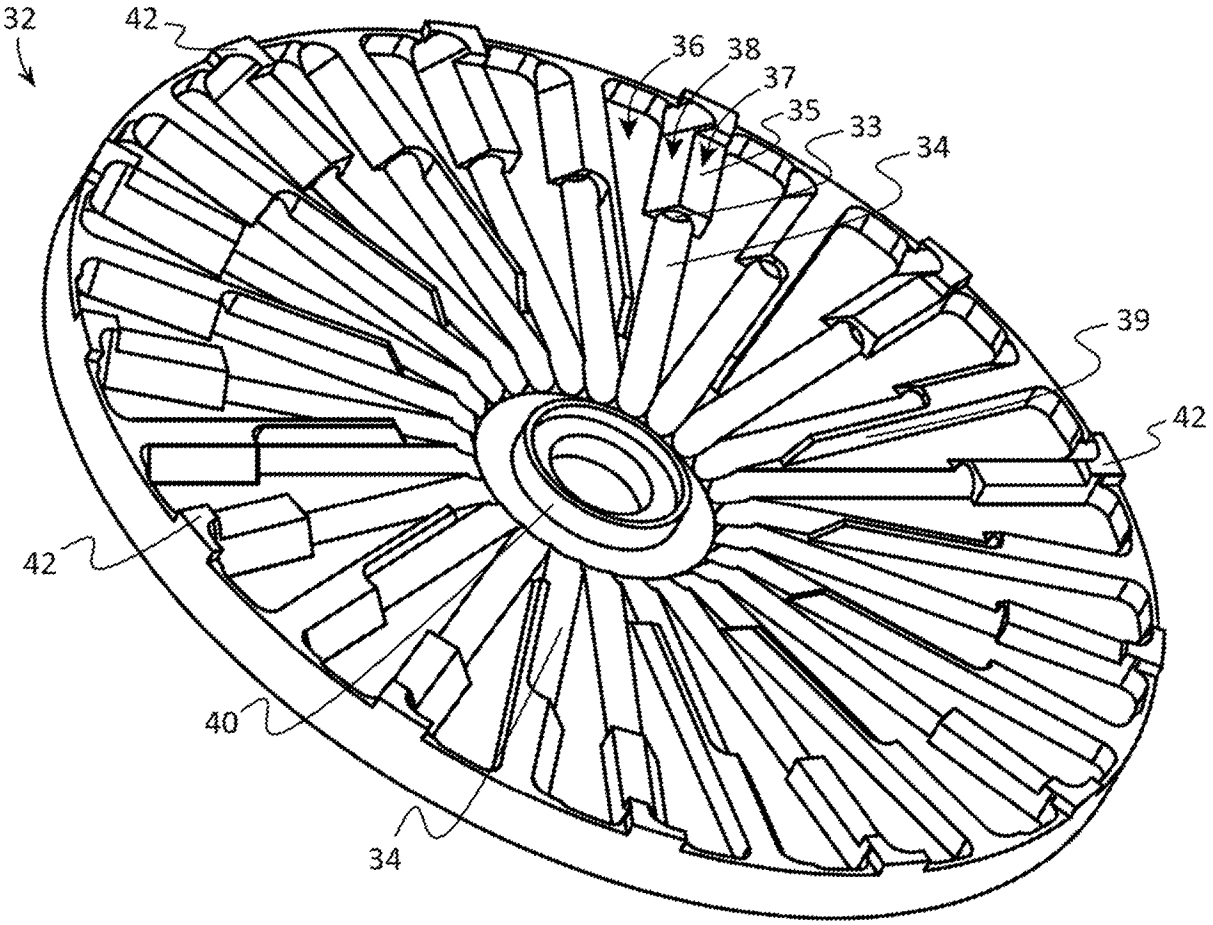
FIG. 9 shows a front side perspective view of an example of a case plate according to various embodiments described herein
Figure 10:
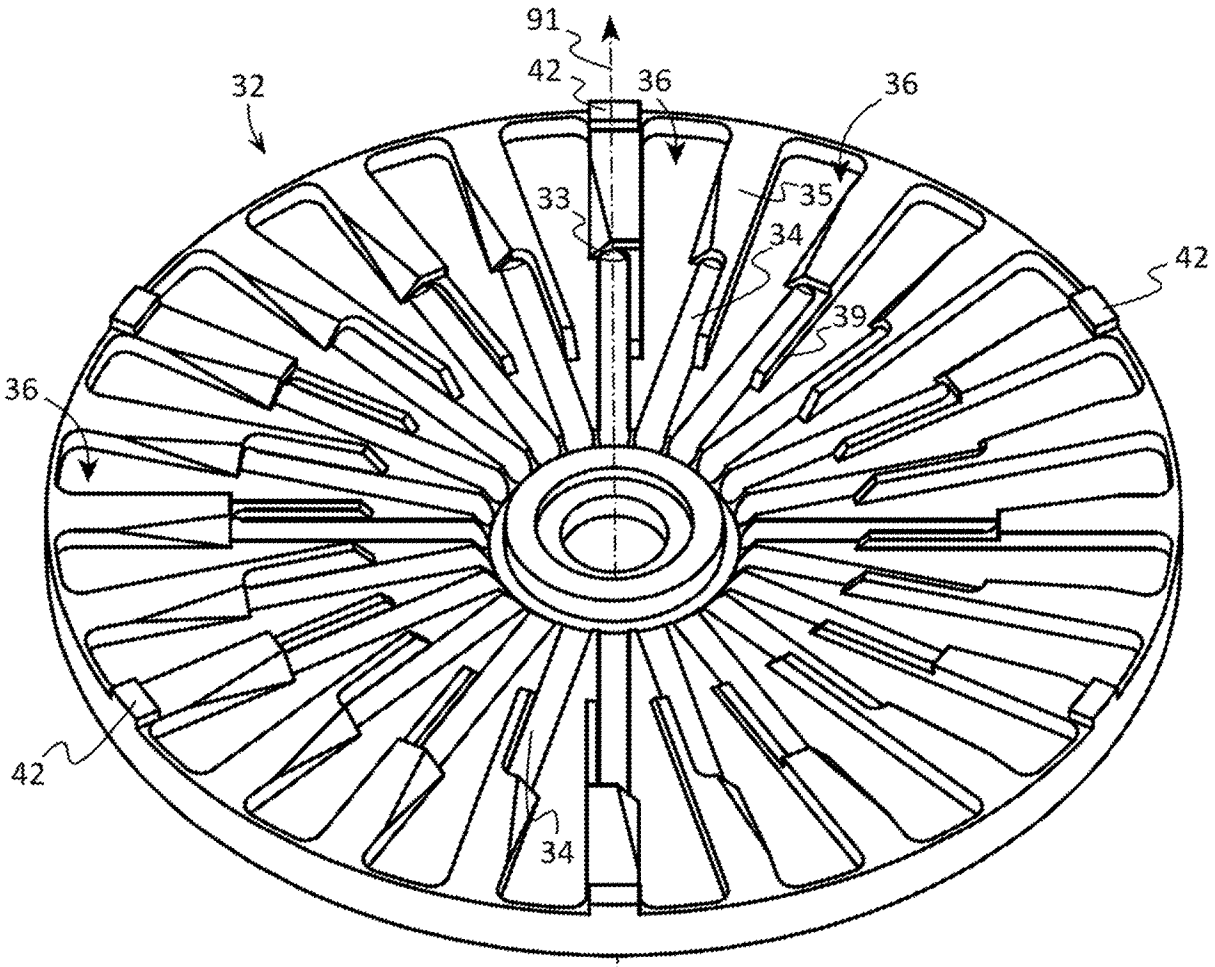
FIG. 10 depicts a front perspective view of another example of a case plate according to various embodiments described herein.
Figure 11:
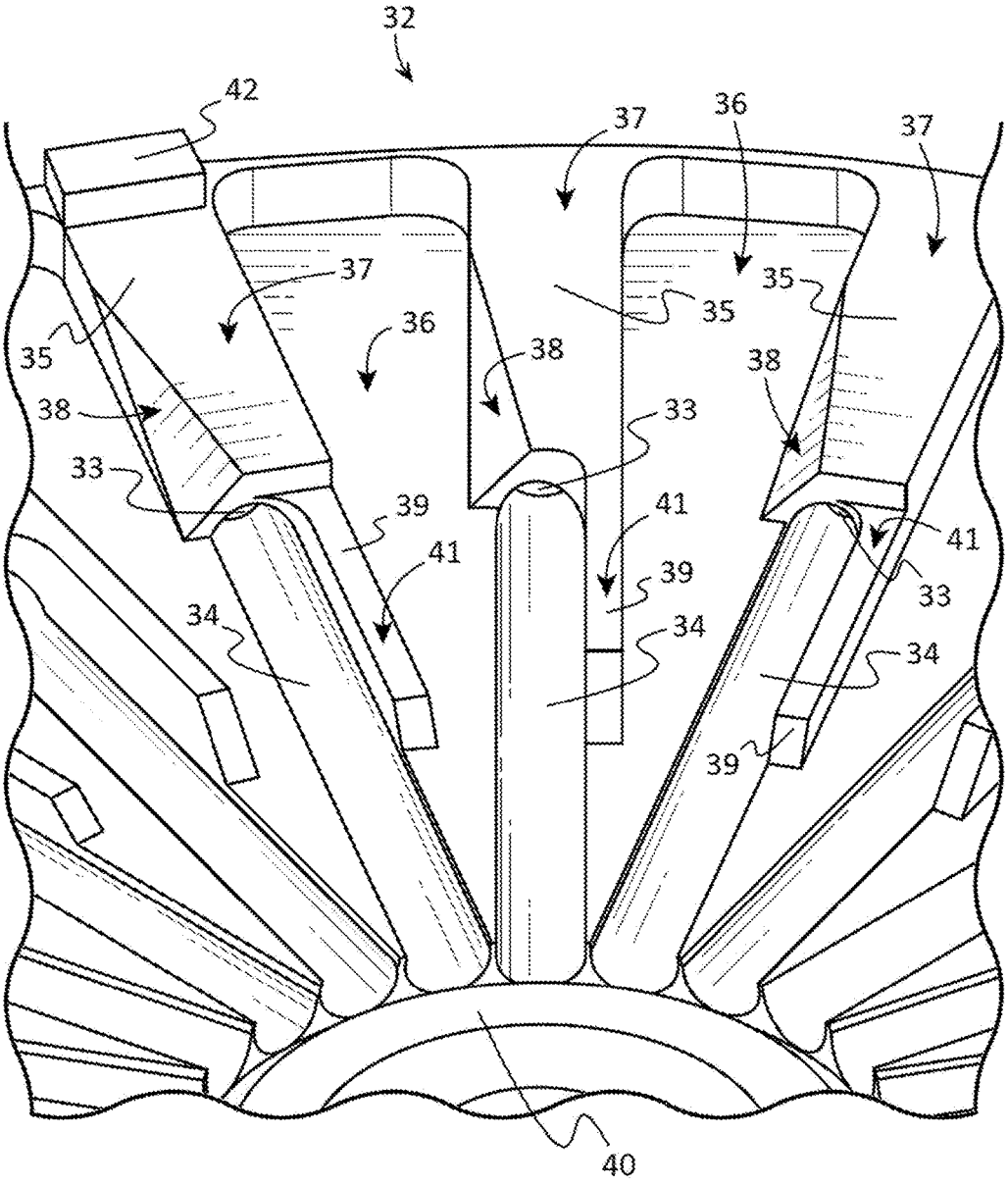
FIG. 11 illustrates an enlarged front perspective view of a portion of an example of a case plate according to various embodiments described herein.
Figure 12:
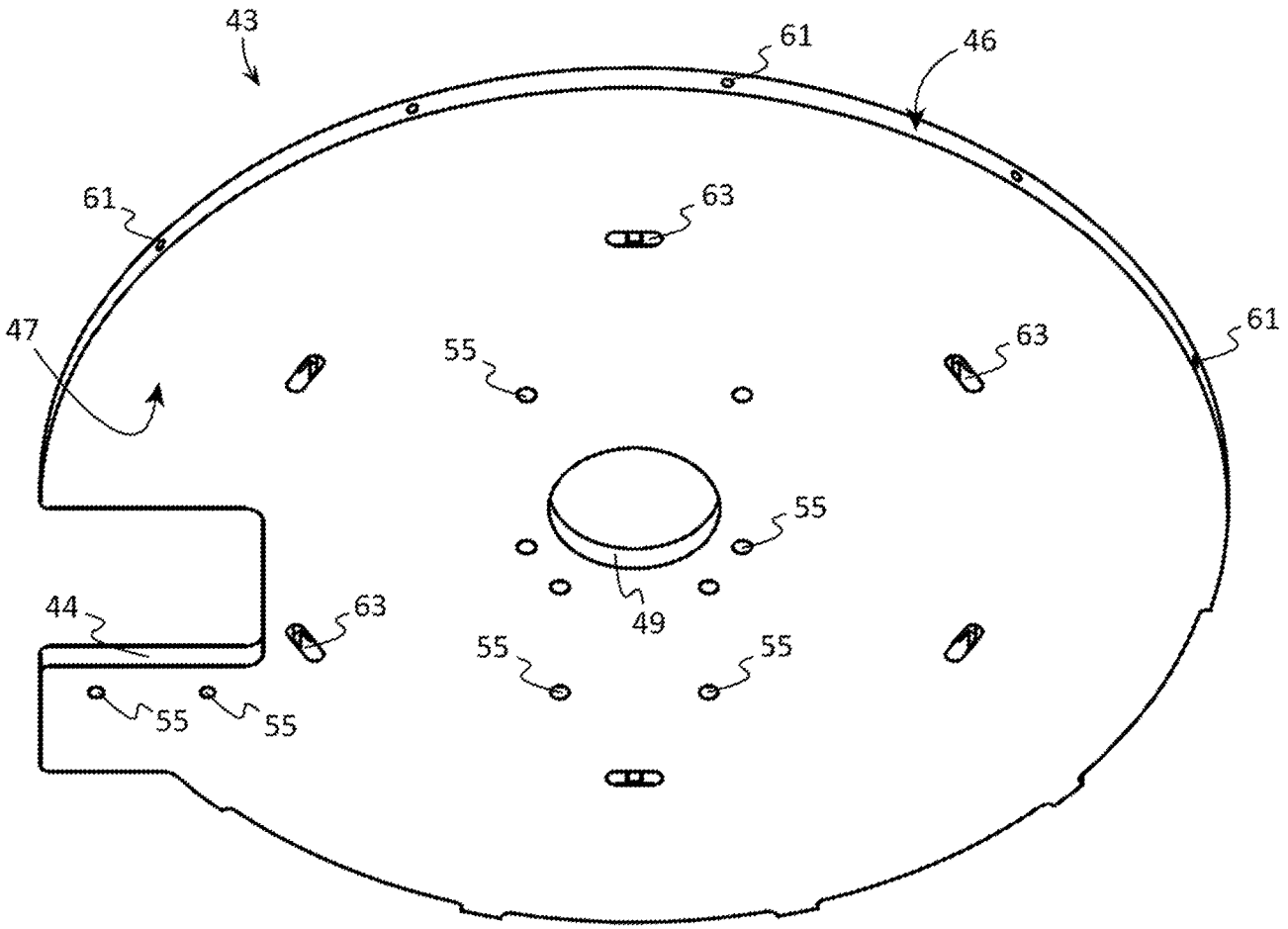
FIG. 12 shows a rear perspective view of an example of a backing plate according to various embodiments described herein.
Figure 13:
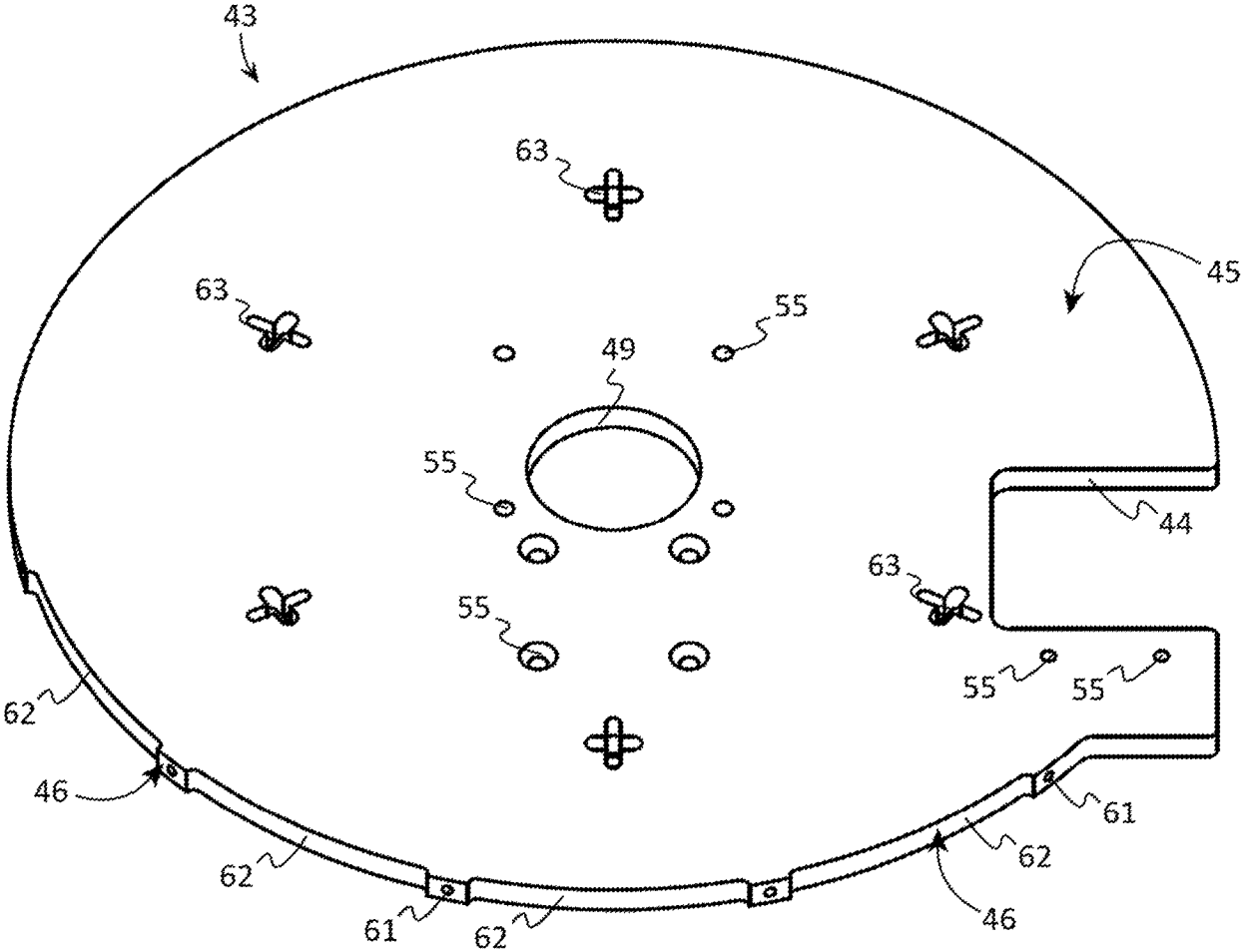
FIG. 13 depicts a front perspective view of an example of a backing plate according to various embodiments described herein.

In preferred embodiments, a drop pocket 33, channel 34, and/or arm 39 may be radially positioned or oriented relative to the axis of rotation 91 so that the drop pocket 33, channel 34, and/or arm 39 may be radially offset from the axis of rotation 91 as shown in FIGS. 8 and 9. By being radially offset from the axis of rotation 91, each drop pocket 33, channel 34, and/or arm 39 may be radially positioned relative to axis of rotation 91 and oriented to the right or left side of the axis of rotation 91. In further embodiments, the W1 of the input chute 11 may be radially offset from the axis of rotation 91. In other embodiments, a drop pocket 33, channel 34, and/or arm 39 may be radially positioned or oriented relative to the axis of rotation 91 so that the drop pocket 33, channel 34, and/or arm 39 may be radially aligned with the axis of rotation 91 as shown in FIGS. 3 and 10. By being radially aligned with the axis of rotation 91, each drop pocket 33, channel 34, and/or arm 39 may be radially positioned relative to axis of rotation 91 and oriented directly towards the axis of rotation 91. In further embodiments, the W1 of the input chute 11 may be radially aligned with the axis of rotation 91.

In some embodiments, the feeding assembly 29 may comprise a backing plate 43 (FIGS. 4-6, 12, and 13) which may be coupled to the hopper 31 and positioned behind the case plate 32 so that the backing plate 43 may be positioned between the case plate 32 and the orientation assembly 18. The backing plate 43 may comprise a conducting aperture 44 which may be aligned with and in communication with the input chute 11. The backing plate 43 may comprise a generally planar upper surface 45 against which the cases 200 in the drop pockets 33 may move across as the case plate 32 is rotated, and once a drop pocket 33 is aligned with the conducting aperture 44, and therefore aligned with the input chute 11, the case 200 that is in the drop pocket 33 may be communicated through the conducting aperture 44 and into the input chute 11. The backing plate 43 may comprise a perimeter surface 46 to which portions of the hopper 31 may be coupled, and a lower surface 47 to which portions of an orientation assembly 18 and/or an alignment mount 51 may be coupled.

One or more elements of the feeding assembly 29, such as a hopper 31, case plate 32, and a backing plate 43, may be made from or may comprise any substantially rigid material. In preferred embodiments, the hopper 31 may be generally cylindrical in shape, and the case plate 32 and optional backing plate 43 may be generally circular in shape which diameters slightly smaller than the diameter of the cylindrical shaped hopper 31. A case plate 32, backing plate 43, hopper 31, alignment mount 51, drive motor 56, mounting bracket 58, and/or transmission 59 may be coupled together with any suitable coupling method. In some embodiments, a backing plate 43 may comprise one or more hopper apertures 61 for attaching the hopper 31, such as with fasteners which may include screws, rivets, etc., with debris escape notches 62 between them which may provide a space to allow dirt and debris to escape. In further embodiments, a backing plate 43 may comprise one or more, such as six, pockets 63, for mounting bearings, such as ball bearings, and their axels which may be configured to contact the case plate 32 to facilitate its ability to rotate. In still further embodiments, a backing plate 43 may comprise one or more fastener apertures 55 of various sizes and shapes for attaching a drive motor 56, transmission 59, and mounting bracket 58, such as with fasteners which may include screws, rivets, etc.

Figure 14:
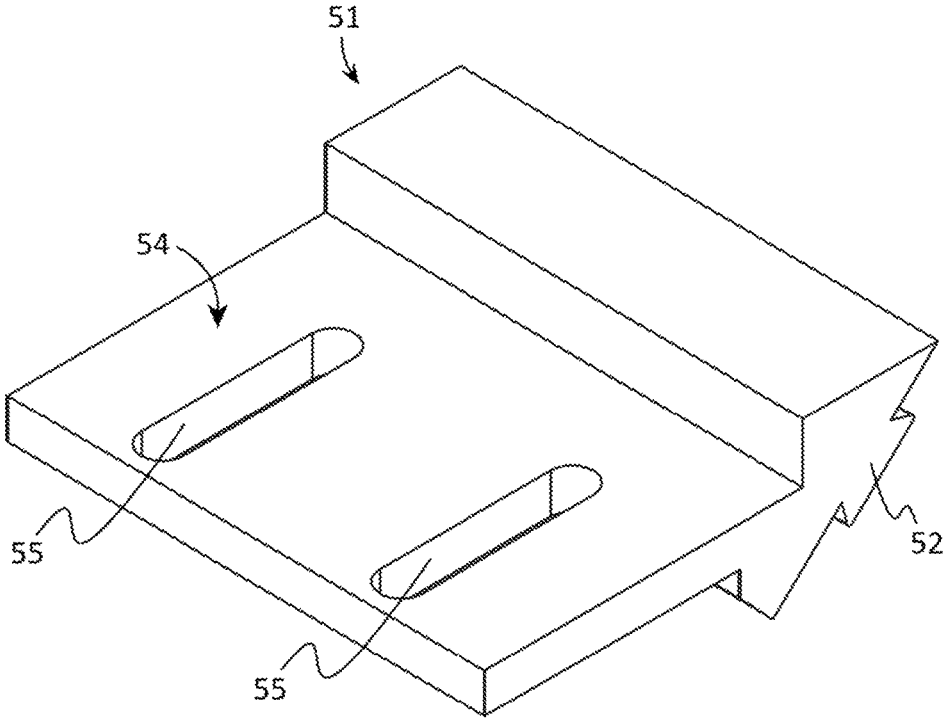
FIG. 14 illustrates a front perspective view of an example of an alignment mount according to various embodiments described herein.

In some embodiments, the device 100 may comprise an alignment mount 51 (FIG. 14) which may be used to couple an orientation assembly 18 to a feeding assembly 29. In further embodiments, an alignment mount 51 may be coupled to an orientation assembly 18 with a male fastener 52 and a female fastener 53. In preferred embodiments, a male fastener 52 and a female fastener 53 may form a dovetail joint which may facilitate positional changes and alignment changes between the orientation assembly 18 and feeding assembly 29. For example, an orientation assembly 18 may comprise a female fastener 53 shaped as a trapezoidal tail and an alignment mount 51 may comprise a male fastener 52 shaped as a trapezoidal pin which may be engaged by sliding together. In other embodiments, a male fastener 52 and a female fastener 53 may be configured as any other type of fastening or coupling method.

In some embodiments, the alignment mount 51 may comprise an alignment mounting surface 54 which may be shaped to contact portions of the feeding assembly 29, such as the lower surface 47 of a backing plate 43. In further embodiments, the alignment mount 51 may comprise one or more fastener apertures 55 which may be configured to receive fasteners, such as screws and bolts, which may be used to couple the alignment mount 51 to portions of the feeding assembly 29. Optionally, the alignment mount 51 may comprise one or more fastener apertures 55 which may be used to couple the alignment mount 51 to portions of the orientation assembly 18. It should be understood, that any coupling method or device may be used to couple the orientation assembly 18 to a feeding assembly 29 so that the drop pockets 33 may be sequentially aligned with the input chute 11 as a case plate 32 is rotated.

In some embodiments, the device 100 may comprise a motor 56 (FIGS. 4-6) which may be configured to rotate the case plate 32 around the axis of rotation 91. Preferably, a motor 56 may comprise an electric motor having a rotor 57 which may be rotated. The rotor 57 may be rotationally coupled to the case plate 32, optionally via a transmission 59, thereby enabling the motor 56 to rotate the case plate 32. A transmission 59 may comprise any mechanical arrangement which provides controlled application of power, such as a gearbox that uses gears and gear trains to provide speed and torque conversions from a rotating power source to another device. In other embodiments, a motor 56 may comprise a hydraulic motor, a pneumatic motor, or any other type of motor suitable for providing mechanical energy which may be used to rotate the case plate 32. Optionally, the device 100 may comprise any type of torque limiter. A torque limiter is an automatic device that protects mechanical equipment, or its work, from damage by mechanical overload. A torque limiter may limit the torque applied to the case plate 32 or other element by slipping (as in a friction plate slip-clutch), or uncouple the load entirely (as in a shear pin). The action of a torque limiter is especially useful to limit any damage due to crash stops and jams. Preferably, a case plate 32 may comprise a case plate aperture 48 and/or a backing plate 43 may comprise a backing plate aperture 49. A case plate aperture 48 may be shaped or otherwise configured to receive a rotational element, such as the rotor 57 of a motor 56, to rotationally couple the case plate 32 to a motor 56, transmission 59, or the like. A backing plate aperture 49 may be shaped or otherwise configured to receive a rotational element, such as the rotor of a motor 56, while allowing the rotational element to pass through the backing plate aperture 49 without causing the backing plate 43 to rotate. Optionally, the device may comprise a mounting bracket 58 which may be configured to support the device 100 and which may be coupled to the motor 56, portions of the feeding assembly 29, such as the lower surface 47 of the backing plate 43, or any other element.

While some materials have been provided, in other embodiments, one or more elements of the device 100, such as elements of the orientation assembly 18, optional case plate 32 and other elements of the optional feeding assembly 29, and/or any other element discussed herein, may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A case orientation device for use with an ammunition case having a length dimension and a diameter dimension, the device comprising:

an input chute coupled to a discharge chute via a funnel, the input chute having a width dimension greater than the length dimension of the ammunition case, the discharge chute having a width dimension less than the length dimension of the ammunition case, and the funnel transitioning from the width dimension of the input chute to the width dimension of the discharge chute;

a splitter disposed in the funnel, the splitter dividing the funnel into a right section and a left section, and the splitter having a tipping surface oriented towards the input chute, wherein the ammunition case enters the input chute in a horizontal orientation, is rotated out of the horizontal orientation via contact with the tipping surface, and is forced into a vertical orientation in one of the sections to enter the discharge chute in the vertical orientation;

a rotatable case plate around an axis of rotation, the case plate having a plurality of drop pockets, wherein each drop pocket is sequentially aligned with the input chute as the case plate is rotated;

wherein each drop pocket is couple to a channel; and wherein each drop pocket is covered by a roof, and wherein a portion of the channel that the drop pocket is coupled to is also covered by the roof.

2. The device of claim 1, wherein the discharge chute has width dimension approximately 101% to 150% of the ammunition case diameter.

3. The device of claim 1, wherein the input chute has width dimension approximately 101% to 165% of the ammunition case length.

4. The device of claim 1, wherein the width dimension of the input chute is radially aligned with the axis of rotation.

5. The device of claim 1 wherein the channels are radially aligned with the axis of rotation.

6. The device of claim 1, wherein the channels are radially offset from the axis of rotation.

7. The device of claim 1 wherein the axis of rotation is approximately between 25 and 65 degrees relative to vertical.

8. The device of claim 1, further comprising a backing plate.

9. A case orientation device for use with an ammunition case having a length dimension and a diameter dimension, the device comprising:

an input chute coupled to a discharge chute via a funnel, the input chute having a width dimension approximately 101% to 165% of the ammunition case length dimension, the discharge chute having a width dimension approximately 101 to 150% of the ammunition case diameter dimension, and the funnel transitioning from the width dimension of the input chute to the width dimension of the discharge chute;

a splitter disposed in the funnel, the splitter dividing the funnel into a right section and a left section, and the splitter having a tipping surface oriented towards the input chute, wherein the ammunition case enters the input chute in a horizontal orientation, is rotated out of the horizontal orientation via contact with the tipping surface, and is forced into a vertical orientation in one of the sections to enter the discharge chute in the vertical orientation;

a rotatable case plate having a plurality of drop pockets, wherein the case plate is rotatable around an axis of rotation, and wherein each drop pocket is sequentially aligned with the input chute as the case plate is rotated;

wherein each drop pocket is coupled to a channel; and wherein each drop pocket and a portion of the channel that the drop pocket is coupled to are each covered by a roof.

10. The device of claim 9, further comprising a backing plate.

11. The device of claim 9, wherein the width dimension of the input chute is radially aligned with the axis of rotation.

12. The device of claim 9, wherein the channels are radially aligned with the axis of rotation.

13. The device of claim 9, wherein the channels are radially offset from the axis of rotation.

14. The device of claim 9, wherein the axis of rotation is approximately between 25 and 65 degrees relative to vertical.

* * * * *